United States Patent [19]

Fallier, Jr. et al.

[11] Patent Number: 4,608,521

[45] Date of Patent: Aug. 26, 1986

[54] DUAL SPIRAL LINE GENERATOR METHOD AND APPARATUS FOR STARTING LOW WATTAGE HIGH INTENSITY DISCHARGE LAMPS

[75] Inventors: Charles N. Fallier, Jr., Westford; Joseph M. Proud, Wellesley Hills, both of Mass.

[73] Assignee: GTE Laboratories Incorporated, Waltham, Mass.

[21] Appl. No.: 686,974

[22] Filed: Dec. 27, 1984

[51] Int. Cl.[4] ..... H01J 7/44; H01J 13/46; H01J 17/34; H01J 19/78

[52] U.S. Cl. ..... 315/47; 307/106; 315/46; 315/287

[58] Field of Search ..... 315/45, 46, 47, 50, 315/60, 289; 307/106, 107, 110

[56] References Cited

U.S. PATENT DOCUMENTS

| | | | |
|---|---|---|---|
| 2,737,612 | 3/1956 | Sims | 315/177 |
| 2,931,948 | 4/1960 | Forgacs | 315/241 |
| 3,195,031 | 7/1965 | Fitch et al. | 317/260 |
| 3,289,015 | 11/1966 | Fitch et al. | 307/110 |
| 3,337,755 | 8/1967 | Grabowski et al. | 307/106 |
| 3,432,663 | 3/1969 | Anderson et al. | 250/98 |
| 3,463,965 | 8/1969 | Peek | 315/272 |
| 3,526,821 | 9/1970 | Thomas | 307/110 X |
| 3,681,604 | 8/1972 | Criswell et al. | 307/106 |
| 3,863,105 | 1/1975 | Ewanizky | 307/110 |
| 3,963,958 | 6/1976 | Nuckolls | 315/276 |
| 4,005,336 | 1/1977 | Casella | 315/289 |
| 4,135,114 | 1/1979 | Narikiyo | 315/47 |
| 4,137,483 | 1/1979 | Ochi et al. | 315/74 |
| 4,140,917 | 2/1979 | Weiner | 307/106 |
| 4,179,640 | 12/1979 | Larson et a. | 315/47 |
| 4,217,468 | 8/1980 | Rice et al. | 178/116 |
| 4,223,247 | 9/1980 | Jacobs et al. | 315/57 |
| 4,325,004 | 4/1982 | Proud et al. | 315/45 |
| 4,328,446 | 5/1982 | Fallier, Jr. et al. | 315/47 |
| 4,353,012 | 10/1982 | Fallier, Jr. et al. | 315/289 |
| 4,379,982 | 4/1983 | Proud | 315/60 |

OTHER PUBLICATIONS

"Novel Principle of Transient High-Voltage Generation" by Fitch et al., *Proceedings IEEE*, vol. III, No. 4, Apr. 1964.

*Primary Examiner*—Saxfield Chatmon

*Attorney, Agent, or Firm*—Hamilton, Brook, Smith & Reynolds

[57] ABSTRACT

A starter circuit for metal halide discharge lamps in which a pair of spiral line generators are coupled between the source of lamp operating power and the electrodes of the high intensity discharge lamp. The spiral line generators are connected across the electrodes, in accordance with the invention, in a manner such that the high voltage short duration pulses from the spiral line generators are substantially additive across the discharge lamp electrodes, thus, in effect, substantially doubling the breakdown voltage available across the discharge lamp electrodes.

4 Claims, 2 Drawing Figures

DUAL SPIRAL LINE GENERATOR METHOD AND APPARATUS FOR STARTING LOW WATTAGE HIGH INTENSITY DISCHARGE LAMPS

BACKGROUND ART

This invention relates to high intensity discharge lamps, more particularly, to methods and apparatus for initiation of the spark discharge in low wattage metal halide lamps which are known to be difficult to start because they require a higher starting voltage than is available from a 115 Volt line and a simple lead-lag ballast.

As described in U.S. Pat. No. 4,353,012, issued Oct. 5, 1982, conventional high intensity discharge metal halide lamps include two main electrodes at opposite ends of a discharge tube and a third starting electrode associated with one of the main electrodes. A starting circuit applies a high voltage between the main electrodes of the lamp and, simultaneously, between the starting electrode and its associated main electrode. A discharge is initiated between the starting electrode and the main electrode by the starting circuit. The discharge then transfers to provide a discharge between the two main electrodes. After a high intensity discharge is formed within the discharge tube, the voltage between the electrodes drops and the starting circuit is no longer operative.

While the starting electrode in metal halide lamps provides generally satisfactory operation, it has certain disadvantages. The complexity and cost of manufacturing the lamp are increased when the starting electrode is used. In addition, the lamp seal in the region of the starting electrode is adversely affected by an electrolysis process when a potential difference exists between the starting electrode and the main electrode. The degradation of the seal can eventually lead to lamp failure. It is known that this problem can be alleviated by connecting a thermal switch, which closes after starting of the lamp, between the main electrode and the starting electrode. However, the thermal switch adds to the overall cost and complexity of the lamp assembly. It is, therefore, desirable to provide a starting arrangement for metal halide lamps wherein the starting electrode can be eliminated.

The spiral line pulse generator, disclosed by R. A. Fitch et al. in U.S. Pat. No. 3,289,015, issued Nov. 29, 1966, is a device capable of storing electrical energy and, upon momentary short circuiting of a pair of terminals, of providing a high amplitude pulse. The spiral line pulse generator can, when properly utilized, provide the dual functions of storage and voltage multiplication. The spiral line pulse generator is a transient field reversal device which provides a roughly triangular pulse. Its peak voltage is a multiple of the initial charging voltage. The use of a spiral line pulse generator to start high pressure sodium lamps is disclosed in U.S. Pat. No. 4,325,004 issued Apr. 13, 1982 and assigned to the assignee of the present application. The output of the spiral line pulse generator is coupled to a conductor, or starting aid, located in close proximity to an outer surface on the central portion of the discharge tube. In the case of metal halide lamps, it has been found undesirable to locate conductors in close proximity to the central portion of the discharge tube, thereby ruling out the use of such a starting aid to assist in initiating discharge.

U.S. Pat. No. 4,353,012 issued Oct. 5, 1982 shows a starting circuit for high intensity discharge metal halide lamps which includes a spiral line pulse generator including two conductors and two insulators, each in the form of an elongated sheet, in an alternating and overlapping arrangement which is rolled together in a spiral configuration having a plurality of turns. The spiral line pulse generator includes an output terminal coupled to one of the electrodes of the lamp and a pair of input terminals. One of the input terminals and the other of the electrodes of the lamp are adapted for coupling to a source of lamp operating power and for delivering lamp operating power, received from the source, through the spiral line pulse generator to the discharge lamp. The starting circuit also includes means for applying a voltage between the conductors of the spiral line pulse generator and for switching the conductors from a first voltage to a second voltage in a time interval much shorter than the transit time of electromagnetic waves through the spiral line pulse generator. After operation of the switch, the spiral line pulse generator provides, at its output terminal, a high voltage, short duration pulse of sufficient energy to initiate discharge in the discharge lamp.

While the starting circuit described in U.S. Pat. No. 4,353,012 is suitable for the purposes intended, its performance could be improved substantially if greater voltage output could be applied to the lamp electrodes, producing a higher breakdown voltage and, thus, more reliable starting.

SUMMARY OF THE INVENTION

In accordance with the present invention, a pair of spiral line generators are coupled between the source of lamp operating power, typically 115 Volts A.C., and the electrodes of the high intensity discharge lamp. The spiral line generators are connected across the electrodes, in accordance with the invention, in a manner such that the high voltage short duration pulses from the spiral line generators are substantially additive across the discharge lamp electrodes, thus in effect, substantially doubling the breakdown voltage available across the discharge lamp electrodes. This results in greatly improved reliability in the starting of such devices.

For a better understanding of the present invention, together with other and further objects, advantages and capabilities thereof, reference is made to the following disclosure and appended claims in connection with the above-described drawings.

BEST MODE OF CARRYING OUT THE INVENTION

Figure 1:
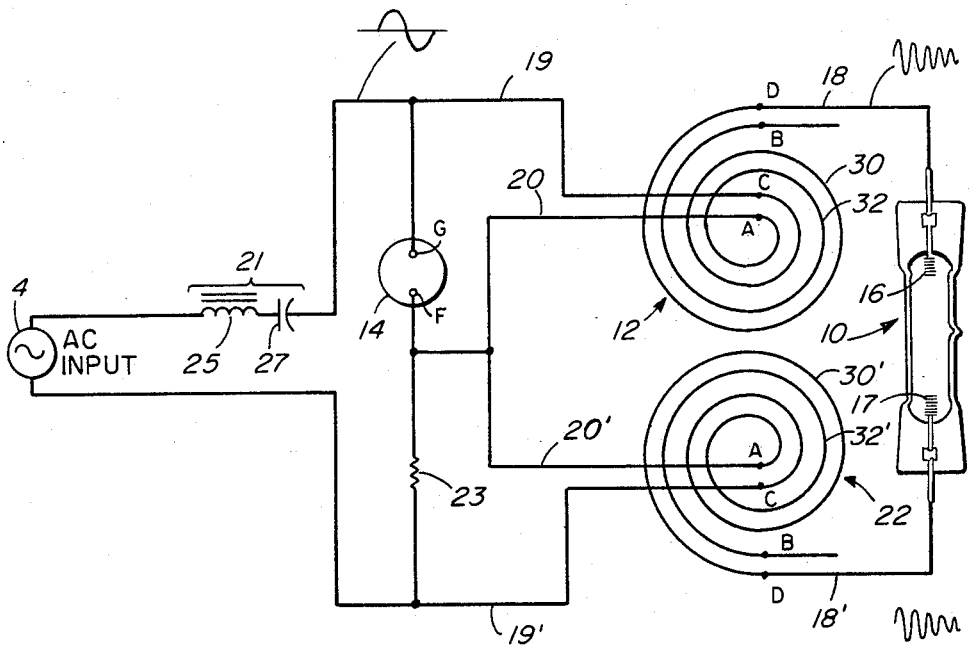
FIG. 1 is a simplified schematic diagram of a preferred embodiment of a dual spiral line pulse generator circuit in accordance with the invention.

A high intensity light source circuit, in accordance with the invention, is shown in FIG. 1 to comprise in general a pair of spiral line generators 12 and 22, coupled across a ballast 21. Ballast 21 is connected to a source of AC power 4. Typically, power source 4 is at line voltage of 110 Volts AC. Ballast 21 typically comprises a series choke or inductor 25 and capacitor 27 to form a lead-lag circuit with approximately unity power factor. Inductor 25 may also be an auto-transformer to step up the line voltage. The spiral line generators 12 and 22 are of the type described in detail in U.S. Pat. No. 4,353,012. Each comprise a pair of conductors 30 and 32 or 30' and 32' in the form of elongated sheets of conductive material separated by a dielectric (not shown) rolled together to form a multiple turn spiral configuration.

The transformer side of ballast 21 is coupled via line 19 to input point C of conductor 30 of spiral line generator 12. Line 19' couples the common side of the AC power to input point C of conductor 30' of spiral line generator 22.

A spark gap switch 14, such as a type CG 145L, in the instant invention, supplied by C. P. Clare division of General Instruments Corporation and having a firing potential of 145 Volts is coupled in series with a charging resistor 23 across the lines 19 and 19' between the ballast and the line generators 12 and 22, respectively. In the case where inductor 25 is an autotransformer, spark gap switch 14 may be chosen to have a firing potential approximating the peak output voltage of ballast 21.

The spark gap electrode connected to resistor 23 is coupled to input point A of generator conductors 32 and 32' of generators 12 and 22, respectively, via leads 20 and 20', respectively.

Output point D of conductors 30 and 30' is coupled via respective leads 18 and 18' to respective electrodes 16 and 17 sealed within the envelope 11 of high intensity discharge lamp 10. Lamp 10 is preferably a metal halide discharge lamp having an envelope 11 enclosing a fill material, such as metal halide, which emits light during discharge. Output point B of generators 12 and 22 is not conductively coupled but, rather, is capacitively coupled to respective conductive lines 18 and 18', such that the voltage pulses produced in generators 18 and 18', as the spark gap is switched from an open circuit to a short circuit on each half cycle of the AC power input voltage is coupled into leads 18 and 18', respectively, in proper phase to add to the voltage difference across electrodes 16 and 17 until a discharge occurs in the lamp 10.

Figure 2:
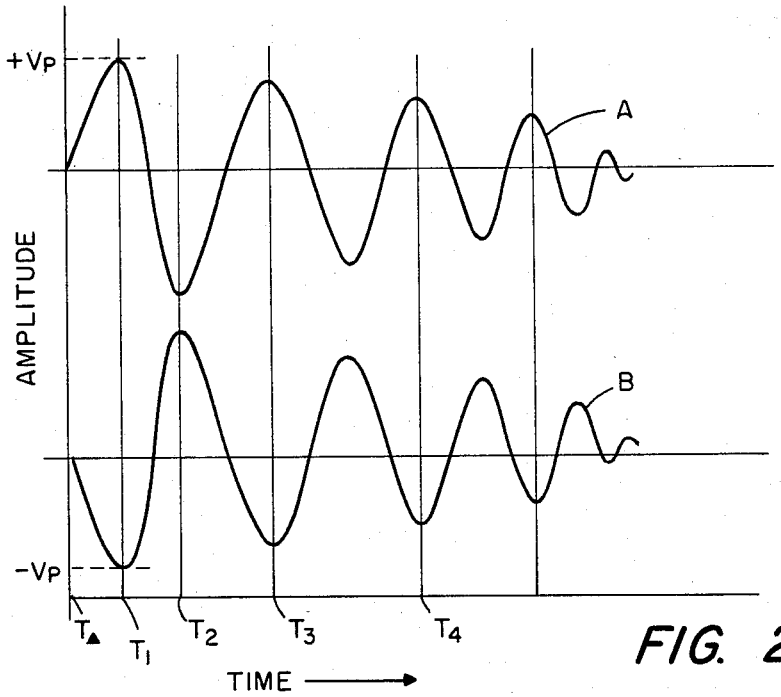
FIG. 2 is a graphic representation of the voltage output of the spiral line pulse generators of FIG. 1.

This is illustrated in FIG. 2, which depicts in curves A and B the idealized decaying voltage waveform induced on lines 18 and 18', respectively, by the respective spiral line generators. As may be seen, the peak voltage at time $T_1$ from generator 12 is $+V_p$ resulting in a net voltage difference across the electrodes 16 and 17 of lamp 10 of $2V_p$. The above voltage waveforms assume that the respective time delays of the spiral line generators are almost perfectly matched. However, even with a slight mismatch, the waveforms are still of opposite phase and additive across the electrodes.

Thus, there is provided by the present invention a light source wherein a metal halide discharge lamp can be reliably started and operated without a requirement for a starting electrode. The manufacturing cost of the discharge lamp without a starting electrode is reduced and the reliability of the discharge lamp is improved. The starting circuit can be enclosed in the lamp base of a light source of conventional configuration. Thus, the light source described herein can directly replace conventional light sources.

EQUIVALENTS

While there has been shown and described what is at present considered the preferred embodiment of the invention, it will be obvious to those skilled in the art that various changes and modifications may be made therein without departing from the scope of the invention as defined by the appended claims.

What is claimed is:

1. A light source comprising:

(a) a high intensity discharge lamp including a discharge tube having electrodes sealed therein at opposite ends and an envelope enclosing a fill material which emits light during discharge;

(b) a ballast means for providing an output voltage equal to or substantially greater than the voltage into said ballast means, adapted to be conductively coupled to a source of AC voltage;

(c) a spark gap switch having first and second electrodes and a resistor coupled in series across the output terminals of said ballast means such that the first electrode of the spark gap means is conductively coupled to an output terminal of said ballast means;

(d) a starting circuit including:

(i) first and second spiral line pulse generators each including two conductors insulated from each other and formed together in a spiral configuration having a plurality of turns;

(ii) said first spiral line pulse generator having a first one of said conductors conductively coupled at a first end to the second electrode of said spark gap and a second end left non-conductively coupled, and the second one of said conductors having a first end conductively coupled to the first electrode of said spark gap, and a second end conductively coupled to a first one of the electrodes of the discharge lamp;

(iii) said second spiral line pulse generator having a first one of said conductors conductively coupled at a first end to the second electrode of said spark gap and at a second end left non-conductively coupled, and the second one of said conductors having a first end conductively coupled to a side of said resistor remote from the second electrode of the spark gap and a second end conductively coupled to a second one of the electrodes of the discharge lamp.

2. The light source of claim 1 wherein the discharge lamp is a metal halide discharge lamp.

3. The light source of claim 1 wherein the time delay of the voltage passed through the conductors is substantially equal in the first and second line pulse generators.

4. The light of claim 1 wherein the first and second line pulse generators store and multiply voltage from the ballast means which is applied across the electrodes of the discharge lamp in opposite polarity.

* * * * *